United States Patent [19]

Bhowal et al.

[11] Patent Number: 5,026,520

[45] Date of Patent: Jun. 25, 1991

[54] FINE GRAIN TITANIUM FORGINGS AND A METHOD FOR THEIR PRODUCTION

[75] Inventors: Prabir R. Bhowal; Samuel V. Thamboo, both of Houston, Tex.

[73] Assignee: Cooper Industries, Inc., Houston, Tex.

[21] Appl. No.: 425,608

[22] Filed: Oct. 23, 1989

[51] Int. Cl.[5] ..... C22F 1/18

[52] U.S. Cl. ..... 420/417; 148/11.5 F; 148/12.7 B; 148/133

[58] Field of Search ..... 148/11.5 F, 12.7 B, 148/133; 420/417

[56] References Cited

U.S. PATENT DOCUMENTS

| | | | |
|---|---|---|---|
| 3,313,138 | 4/1967 | Spring et al. | 72/364 |
| 3,470,034 | 9/1969 | Kastanek et al. | 148/11.5 |
| 3,489,617 | 1/1970 | Wuerfel | 148/11.5 |
| 3,635,068 | 1/1972 | Watmough et al. | 72/342 |
| 3,686,041 | 8/1972 | Lee | 148/11.5 R |
| 4,098,623 | 7/1978 | Ibaraki et al. | 148/11.5 F |
| 4,675,055 | 6/1987 | Ouchi et al. | 148/11.5 F |
| 4,799,975 | 1/1989 | Ouchi et al. | 148/11.5 F |
| 4,854,977 | 8/1989 | Alheritiere et al. | 420/417 |
| 4,878,966 | 11/1989 | Alheritiere et al. | 148/11.5 F |

*Primary Examiner*—Upendra Roy

[57] ABSTRACT

Fine grain titanium forgings and to a process for refining the grain size of $\alpha$ and $\alpha$-$\beta$ titanium alloys through forging and recrystallization above the alloy's $\beta$-transus temperature. Specifically, the method employs an isothermal press in which a billet heated above the alloy's $\beta$-transus temperature, forged to produce an elongated, flattened grain structure, is held above the alloy's $\beta$-transus temperature for a predetermined time to allow fine grains to nucleate and grow through recrystallization, and then is quenched to arrest grain growth and to establish a fine grained titanium alloy. A second forging step may be employed to attain an aspect ratio of the grains. The fine grained titanium forgings made by this process have a maximum prior $\beta$-grain size of 0.5 mm throughout the workpiece.

15 Claims, 13 Drawing Sheets

CURRENT PROCESS

NEW PROCESS

FINE GRAIN TITANIUM FORGINGS AND A METHOD FOR THEIR PRODUCTION

FIELD OF THE INVENTION

This invention relates to fine grain titanium forgings and to a process for refining the grain size of $\alpha$ and $\alpha$-$\beta$ titanium alloys through forging and recrystallization above the alloy's $\beta$-transus temperature. Specifically, the method employs an isothermal press in which a billet heated above the alloy's $\beta$-transus temperature, is transferred and then forged to produce an elongated, flattened grain structure, is held above the alloy's $\beta$-transus temperature for a predetermined time to allow fine grains to nucleate and grow through recrystallization, and then is quenched to arrest grain growth and to establish a fine grained titanium alloy. A second forging step may be employed to change the aspect ratio of the grains. The fine grained titanium forgings made by this process have a maximum prior $\beta$-grain size of 0.5 mm throughout the workpiece.

BACKGROUND OF THE INVENTION

Titanium and titanium alloys are popular in the design of parts requiring a high strength-to-weight ratio and are particularly popular for parts to be employed in high temperature service, such as for jet engine parts. Titanium alloys for high temperature use require a fine grain size in order to enjoy improved mechanical properties over larger grained titanium alloys and in order to be inspected more efficiently. For example, when detecting internal defects by ultrasonic, non-destructive methods, the presence of large grains creates "background noise" or interference which generally requires rejection of the part. The presence of small grains, however, produces sonically quiet workpieces, that is, workpieces with minimum interference to sonic testing.

In certain applications, such as selected aerospace applications, certain manufacturers' specifications dictate that the grain size must not exceed 0.5 mm. Such limitations are associated with parts which, for example, are placed in high temperature service. In attempting to achieve fine grain size in titanium forgings, several processes exist, but none are directed to an isothermal forging process wherein $\alpha$ and $\alpha$-$\beta$ titanium alloy bodies, such as bodies of Ti-6242 or Ti-17, are finish forged from a billet placed in an isothermal press to produce a workpiece having a maximum grain size not exceeding 0.5 mm. A discussion of each of these existing processes follows.

In U.S. Pat. No. 3,313,138, Spring et al disclose a process for forging billets of $\alpha$-$\beta$ titanium base alloys. Spring et al utilize a V-die, rather than a flat die, and conduct the forging operation at a temperature below the $\beta$-transus temperature of the $\alpha$-$\beta$ alloy being worked. Spring et al teach that it is essential that a certain amount of work be done on the workpiece in the V-die forging step and state that it is essential that such step reduce the cross-sectional area of the workpiece by at least 10% or more, up to 50%, but preferably about 30%. In addition, Spring et al teach that it is possible to conduct some, or even most of the V-die forging step at temperatures above the $\beta$-transus, so long as such forging is followed by forging below the $\beta$-transus temperature to the extent of at least 10% reduction in cross-sectional area as a final part of the V-die forging step.

In U.S. Pat. No. 3,470,034, Kastanek et al disclose a process for producing a fine grained titanium alloy macrostructure which process involves heating an ingot or billet to a temperature between 50° and 250° F. above the alloy's $\beta$-transus and then hot working, for example, by forging, the heated alloy as its temperature decreases to within a range of 50° to 300° F. below the alloy's $\beta$-transus. This process is repeated in a cyclical manner producing progressively a finer grain size until a fine-grained titanium alloy macrostructure is achieved throughout the workpiece. This fine-grained macrostructure allows the material of the workpiece to be ultrasonically tested to exacting standards. Kastanek et al disclose that such a fine-grained macrostructure is necessary in order to reduce "background noise" and to produce sonically quiet billets, that is, billets with minimum interference to sonic testing.

In U.S. Pat. No. 3,489,617, Wuerfel discloses a method for processing bodies of $\alpha$ and $\alpha$-$\beta$ type titanium base alloys which process involves refining the $\beta$-grain size of $\alpha$ and $\alpha$-$\beta$ type titanium base alloys and more particularly, involves refining the $\beta$-grain size of such alloys during processing of ingots to billets for forging stock. Wuerfel's method consists of working a workpiece of the alloy from an initial temperature above the $\beta$-transus to impart strain energy to the metal and recrystallizing the $\beta$-grains. The recrystallization may be effected either simultaneously with working or by a separate anneal at a temperature at least as high as the initial working temperature. Specifically, Wuerfel teaches that his method must utilize an initial working temperature above the $\beta$-transus of the alloy being processed and preferably will be between about 100° and about 500° F. above the $\beta$-transus of the alloy. Wuerfel points out that at temperatures on the higher side of the range, dynamic recrystallization will occur simultaneously with working and will, therefore, take place throughout a large part of the working cycle, while at temperatures on the lower side of the range, an anneal at a temperature at or above the initial working temperature is required to effect recrystallization. Such an anneal generally will be between 2100° F. and about 2400° F., but must be at least as high as the initial working temperature. In Wuerfel's method, the anneal time is critical since it must be of sufficient duration to bring the metal body into the $\beta$ field throughout its extent. Wuerfel teaches that the anneal time will vary, for example, between about one hour and about four hours with the higher temperatures (e.g., those approaching 2400° F., e.g., 2300° F.) being employed with shorter time periods (e.g., those approaching one hour), and with the lower temperatures (e.g., those approaching 2100° F.) being employed with longer time periods (those approaching four hours). Finally, Wuerfel teaches a single step process in which recrystallization is combined with working; the working must be initiated at temperatures substantially above the $\beta$-transus of the alloy and that about 2200° F. is the minimum for both the $\alpha$ and the $\alpha$-$\beta$ type alloys with the preferred temperature range being from about 2200° F. to about 2400° F.

In U.S. Pat. No. 3,686,041, Lee discloses a process for producing ultra fine-grained titanium alloy microstructures which process involves heating the titanium alloy body to a temperature below the alloy's $\beta$-transus temperature, but above its martensitic transformation temperature, hot working the heated alloy body as its temperature decreases, quenching, and repeating the cycle at least once. Lee does not teach, however, the heating of the titanium alloy above the $\beta$-transus temperature.

In U.S. Pat. No. 3,635,068, Watmough et al disclose a method for bulk plastic deformation of titanium and titanium alloys utilizing elevated deforming temperatures in dies that are heated to or close to the workpiece temperature. The method taught by Watmough et al involves isothermal forming of the workpiece by heating the workpiece to a temperature above 1400° F. and heating the dies to the same or a slightly lower temperature. The workpiece is preheated; the dies are heated by conventional heating methods, preferably by means external to the dies such as induction heating coils. Watmough et al disclose that the desirability of forming above or below the $\beta$-transus depends upon the desired properties for the specific application of the alloy employed, and note that an important aspect of the process is control of the die speed during pressing.

SUMMARY OF THE INVENTION

The present invention provides a method for refining the grain size of $\alpha$ and $\alpha$-$\beta$ titanium alloys by producing a fine-grained titanium alloy having a maximum grain size of 0.5 mm throughout the workpiece. With certain prior art processes, a workpiece can attain grain size less than 0.5 mm, but generally not throughout the workpiece, this is especially true with thick workpieces such as turbine discs.

In conventionally forged workpieces or billets, the workpiece uniformly is heated to a temperature above the alloy's $\beta$-transus temperature, then forged and allowed to cool. The forging step causes equiaxed grains to become flattened and elongated. After forging and cooling, the workpiece is then annealed below the alloy's $\beta$-transus temperature to obtain certain properties in the forged material; during annealing the grains remain flattened and elongated. These flattened, elongated grains may exceed the maximum grain size intended for that workpiece and due to the size of certain of the grains, may cause the workpiece to fail ultrasonic inspection. Further, annealing is generally undertaken for an extended period such as an hour or longer. During this time, hard, brittle $\alpha$-case forms on the outer portion of the workpiece and titanium oxide may cover the exterior of the workpiece. The titanium oxide and $\alpha$-case must be removed, for example, by machining before continued processing of the workpiece.

In a similar conventional process, the workpiece is heated to a temperature above the alloy's $\beta$-transus temperature, then forged and allowed to cool. The forging step causes the equiaxed grains to become flattened and elongated. To form small grains, the workpiece is reheated above the alloy's $\beta$-transus temperature and annealed allowing recrystallization wherein the flattened grains recrystallize to become small grains. Unfortunately, however, the recrystallized grains continue to grow to become large grains which may exceed the maximum grain size intended for that workpiece. This variation in grain size or grain size gradient occurs due to the temperature gradient which the work piece experiences during annealing. The workpiece is placed in an annealing furnace and is heated, but the workpiece does not experience the annealing temperature immediately throughout the workpiece. The exterior reaches the annealing temperature before the center of the workpiece. Accordingly, although recrystallization occurs, the longer that a selected area of the workpiece is subjected to the elevated temperature, the larger the recrystallized grains will grow. Thus, the conventionally forged workpiece will have a non-homogeneous grain size where certain of the grains may have a size greater than the grain size intended for that workpiece.

Further, annealing is generally undertaken for an extended period such as an hour or longer. During this time, hard, brittle $\alpha$-case forms on the outer portion of the workpiece and titanium oxide may cover the exterior of the workpiece. The titanium oxide and $\alpha$-case must be removed, for example, by machining before continued processing of the workpiece. Such unwanted build-up does not occur with the process of the instant invention because the holding times are markedly shorter (e.g., four (4) to ten (10) minutes).

In the process of the present invention, a titanium alloy billet is heated above the alloy's $\beta$-transus temperature, but below the temperature at which dynamic recrystallization occurs. Although this process may be practiced at a temperature slightly above the alloy's $\beta$-transus temperature (e.g., 5° F. above), the preferred process temperature is 50° F. above the alloy's $\beta$-transus temperature to allow for slightly inaccurate furnace control and temperature readings, but not more than 100° F. above the alloy's $\beta$-transus temperature to avoid dynamic recrystallization. Accordingly, the preferred temperature range employed in the process of the present invention is 50° F. to 100° F. above the alloy's $\beta$-transus temperature.

Preferably, a titanium alloy billet is heated to a temperature between 50° F. and 100° F. above that alloy's $\beta$-transus temperature, hot worked through pressing in an isothermal press, held at a temperature above the alloy's $\beta$-transus temperature to allow a selected degree of recrystallization, and then quenched to a temperature below the alloy's $\beta$-transus temperature to arrest grain growth and to establish the desired grain morphology. This process allows both the formation of worked grains and the formation of nuclei of recrystallized grains during the isothermal pressing phase and allows both further nucleation and growth of existing nuclei during the holding phase. The initial pressing step is important since pressing is undertaken at a temperature which is lower than the temperature which would effect dynamic crystallization in the titanium alloy body. The holding step generally is undertaken at a temperature between 50° F. and 100° F. above the alloy's $\beta$-transus temperature and preferably is equivalent to the temperature used during the pressing phase; the holding step is important because nucleation and grain growth occur and continue until the fine grains which are formed mutually impinge one upon another. When mutual impingement is complete, the titanium alloy body is quenched to a temperature below the alloy's $\beta$-transus temperature in order to arrest grain growth. The entire process of the invention is undertaken above the alloy's $\beta$-transus temperature and avoids cooling below the alloy's $\beta$-transus temperature prior to recrystallization.

Another aspect of this invention is to achieve additional desirable characteristics in the titanium alloy body by undertaking a second pressing step, which step occurs immediately after the holding step and before the quenching step. This second pressing step is accomplished at the same temperature utilized in the holding step in order to avoid the formation of an $\alpha$-phase occurring as a film predominantly at the grain boundaries. The $\alpha$ phase occurs as the titanium alloy body cools below the $\beta$-transus temperature, and degrades the titanium alloy body by providing a path for crack growth. The second deformation step transforms each grain from an equiaxed shape to an elongated, flattened shape having its long axis positioned in the radial direction and its short axis positioned in the axial direction. Such positioning allows improved mechanical properties in the radial direction, an important consideration in applications where the stresses encountered are at a maximum in the radial direction, such as in rotating turbine disks. In addition, the second deformation step causes the continuous α-phase occurring at the grain boundaries during subsequent cooling, to form as a more zigzag morphology which morphology retards crack growth along the grain boundary α-phase.

The method of the present invention allows the titanium alloy body to attain a substantially uniform fine prior β-grain morphology wherein the maximum grain size is 0.5 mm. Such substantial uniformity is achieved because every location within the body experiences the same temperature at and for the same time during the pressing and holding steps. This uniformity is not available as with conventionally forged workpieces where an annealing furnace is utilized to reheat the workpiece. This is so because the holding time utilized in the method of the present invention is short (on the order of four (4) and ten (10) minutes as required for Ti-6242 and Ti-17, respectively) and such short times do not allow for thick titanium alloy bodies to be heated uniformly in an annealing furnace.

The theory of the instant invention was tested in preliminary experiments by forging test specimens above each specimen's β-transus temperature, cooling each specimen and then cutting small slices (e.g., one-tenth (1/10) of an inch in thickness) and heating those slices above that specimen's β-transus temperature and holding for varying lengths of time (e.g., 2, 4, 6 and 8 minutes), quenching the slices and observing the microstructure of each slice to determine the extent of recrystallization of β-grains. The results of those preliminary experiments are shown for Ti-17 forgings in FIGS. 1a–1d and are shown for Ti-6242 forgings in FIGS. 2a–2d.

The term β-transus temperature refers to the 100% β-transus temperature which is the minimum temperature at which 100% of the material is converted to the β-phase. This temperature for a given alloy composition is established by test specimens after a heat treatment of one hour at a selected temperature as evidenced by microstructural examination. The β-transus temperatures for most well known titanium alloys range from about 1400° F. to about 2000° F.

It is an object of this invention to provide a method for producing in titanium alloy bodies microstructures of fine grain size wherein the maximum grain size does not exceed 0.5 mm.

It is a further object of this invention to provide a method for producing in titanium alloy bodies microstructures of fine-grain size wherein the maximum grain size does not exceed 0.5 mm and is achieved generally through isothermal pressing preferably at a temperature of 50° F. to 100° F. above the alloy's β-transus temperature, but below the dynamic recrystallization temperature for the alloy utilized, and by holding at a temperature above the β-transus temperature for a period necessary to achieve mutual impingement of the fine grains without allowing for grain growth in excess of 0.5 mm.

It is the further object of this invention to provide a method for producing in titanium alloy bodies microstructures of fine grain size wherein the maximum grain size does not exceed 0.5 mm and is achieved through isothermal pressing followed by a holding period and ending in a quench, wherein the isothermal pressing and holding period are undertaken preferably at a temperature of 50° F. to 100° F. above the alloy's β-transus temperature.

It is the further object of this invention to provide a method for producing in titanium alloy bodies microstructures of fine grain size wherein the maximum grain size does not exceed 0.5 mm and is achieved through an initial isothermal pressing followed by a holding period and a second isothermal pressing followed by a quench, wherein each pressing and the holding period is undertaken at a temperature of 50° F. to 100° F. above the alloy's β-transus temperature.

It is the further object of this invention to provide a method for producing in titanium alloy bodies microstructures of fine grain size wherein the maximum size does not exceed 0.5 mm and is achieved through an initial isothermal pressing followed by a holding period and a second isothermal pressing followed by a quench wherein each pressing and holding period is undertaken at a temperature of 50° F. to 100° F. above the alloy's β-transus temperature and the second pressing is undertaken to deform the recrystallization grains and to change each grain's shape from an equiaxed to a flattened shape with each grain's long axis positioned in the radial direction and each grain's short axis positioned in the axial direction.

It is the further object of the present invention to provide a method for producing titanium alloy bodies having a maximum grain size less than 0.5 mm, which grain size facilitates ultrasonic inspection through reduction of ultrasonic noise caused by larger grains.

DESCRIPTION OF THE DRAWINGS

FIG. 1a is a photomicrograph at 50X showing no grain nucleation and growth processes occurring in a Ti-17 forging at 2 minutes hold time at 1650° F. following 70% β-reduction.

FIG. 1b is a photomicrograph at 50X showing a limited amount of grain nucleation and growth processes occurring in a Ti-17 forging after 4 minutes hold time at 1650° F. following 70% β-reduction.

FIG. 1c is a photomicrograph at 50X showing increased grain nucleation and growth processes occurring in a Ti-17 forging after 6 minutes hold time at 1650° F. following 70% β-reduction.

FIG. 1d is a photomicrograph at 50X showing substantially complete grain nucleation and continuing growth processes occurring in a Ti-17 forging after 8 minutes hold time at 1650° F. following 70% β-reduction.

FIG. 2a is a photomicrograph at 50X showing no grain nucleation and growth processes occurring in a Ti-6242 forging after 2 minutes hold time at 1850° F. following 70% β-reduction.

FIG. 2b is a photomicrograph at 50X showing substantial grain nucleation and growth processes occurring in a Ti-6242 forging after 4 minutes hold time at 1850° F. following 70% β-reduction.

FIG. 2c is a photomicrograph at 50X showing completed grain nucleation and continuing growth processes occurring in a Ti-6242 forging after 6 minutes hold time at 1850° F. following 70% β-reduction.

FIG. 2d is a photomicrograph at 50X showing completed grain nucleation and completed growth processes occurring in a Ti-6242 forging after 8 minutes hold time at 1850° F. following 70% β-reduction.

FIG. 3 is a graphical representation of grain growth kinetics and percent recrystallization for a Ti-17 forging at 1650° F. after both 30% β-reduction and 70% β-reduction.

FIG. 4 is a graphical representation of grain growth kinetics and percent recrystallization for a Ti-6242 forging at 1850° F. after 70% β-reduction.

FIG. 5*a* is a photomicrograph at 100X showing a Ti-17 forging having 30% β-reduction, plus 8 minutes holding; then 30% β-reduction, plus 8 minutes holding; then 30% β-reduction to develop the aspect ratio of the grains; the forging was solution treated at 1475° F. for 2 hours and water quenched.

FIG. 5*b* is a photomicrograph at 100X showing a Ti-17 forging having 70% β-reduction, plus 8 minutes holding; then 30% β-reduction, plus 8 minutes holding yielding equiaxed grains; the forging was solution treated at 1475° F. for 2 hours and water quenched.

FIG. 5*c* is photomicrograph at 100X showing a Ti-17 forging having 30% β-reduction, plus 8 minutes holding; then 70% β-reduction, plus 8 minutes holding yielding equiaxed grains; the forging was solution treated at 1475° F. for 2 hours and water quenched.

FIG. 5*d* is a photomicrograph at 100X showing a Ti-17 forging having 50% β-reduction, plus 8 minutes holding; then 50% β-reduction, plus 8 minutes holding yielding equiaxed grains; the forging was solution treated at 1475° F. for 2 hours and water quenched.

FIG. 5*e* is the same as FIG. 5*a*, but at 500X, that is, FIG. 5*e* is a photomicrograph at 500X showing a Ti-17 forging having 30% β-reduction, plus 8 minutes holding; then 30% β-reduction, plus 8 minutes holding; then 30% β-reduction to develop an aspect ratio of the grains; the forging was solution treated at 1475° F. for 2 hours and water quenched.

FIG. 5*f* is the same as FIG. 5*b*, but at 500X, that is, a photomicrograph at 500X showing a Ti-17 forging having 70% β-reduction, plus 8 minutes holding; then 30% β-reduction, plus 8 minutes holding yielding equiaxed grains; the forging was solution treated at 1475° F. for 2 hours and water quenched.

FIG. 5*g* is the same as FIG. 5*c*, but at 500X, that is, a photomicrograph at 500X showing a Ti-17 forging having 30% β-reduction, plus 8 minutes holding; then 70% β-reduction, plus 8 minutes holding yielding equiaxed grains; the forging was solution treated at 1475° F. for 2 hours and water quenched.

FIG. 5*h* is the same as FIG. 5*d*, but at 500X, that is, a photomicrograph at 500X showing a Ti-17 forging having 50% β-reduction, plus 8 minutes holding; then 50% β-reduction, plus 8 minutes holding yielding equiaxed grains; the forging was solution treated at 1475° F. for 2 hours and water quenched.

FIG. 6*a* is a photomicrograph at 50X showing the grain structure in a Ti-6242 upset forging using the process of this invention with a hold time of one (1) minute after 70% β-reduction.

FIG. 6*b* is a photomicrograph at 50X showing the grain structure in a Ti-6242 upset forging using the process of this invention with a hold time of four (4) minutes after 70% β-reduction.

FIG. 6*c* is a photomicrograph at 50X showing the grain structure in a Ti-6242 upset forging using the process of this invention with a hold time of seven (7) minutes after 70% β-reduction.

FIG. 7*a* is a photomicrograph at 50X taken at mid-section showing an upset forging of Ti-17 alloy material using a conventional process with 30% α-β and 70% β-reduction.

FIG. 7*b* is a photomicrograph at 50X taken at mid-section showing an upset forging of Ti-17 alloy material using a conventional process with 70% α-β and 30% β-reduction.

FIG. 7*c* is a photomicrograph at 50X taken at mid-section showing an upset forging of Ti-17 alloy material using a conventional process with 70% β-reduction followed by 30% β-reduction.

FIG. 8*a* is a photomicrograph at 50X taken at the center portion showing an upset forging of Ti-17 alloy material using the process of this invention with 50% reduction, plus 8 minutes holding, followed by 50% reduction, plus 4.5 minutes holding, followed by 30% aspect forging.

FIG. 8*b* is a photomicrograph at 50X taken near the bottom portion showing an upset forging of Ti-17 alloy material using the process of this invention with 50% reduction, plus 8 minutes holding, followed by 50% reduction, plus 4.5 minutes holding, followed by 30% aspect forging.

FIG. 8*c* is a photomicrograph at 50X taken at the center portion showing an upset forging of Ti-17 alloy material using the process of this invention with 50% reduction, plus 8 minutes holding, followed by 50% reduction, plus 4.5 minutes holding, followed by 30% aspect forging.

FIG. 8*d* is a photomicrograph at 50X taken near the bottom portion showing an upset forging of Ti-17 alloy material using the process of this invention with 50% reduction, plus 8 minutes holding, followed by 50% reduction, plus 4.5 minutes holding, followed by 30% aspect forging.

FIG. 9*a* is a photomicrograph at 50X taken at the center portion showing an upset forging of Ti-17 alloy material using the process of this invention with 70% reduction, plus 8 minutes holding following by 30% reduction, plus 4.5 minutes holding, followed by 30% aspect forging.

FIG. 9*b* is a photomicrograph at 50X taken near the bottom portion showing an upset forging of Ti-17 alloy material using the process of this invention with 70% reduction, plus 8 minutes holding following by 30% reduction, plus 4.5 minutes holding, followed by 30% aspect forging.

FIG. 9*c* is a photomicrograph at 50X taken at the center portion showing an upset forging of Ti-17 alloy material using the process of this invention with 70% reduction, plus 8 minutes holding following by 30% reduction, plus 4.5 minutes holding, followed by 30% aspect forging.

FIG. 9*d* is a photomicrograph at 50X taken near the bottom portion showing an upset forging of Ti-17 alloy material using the process of this invention with 70% reduction, plus 8 minutes holding following by 30% reduction, plus 4.5 minutes holding, followed by 30% aspect forging.

FIG. 10*a* is a photomicrograph at 50X of an upset forging of a Ti-6242 alloy material using a conventional process with 30% α-β reduction followed by 70% reduction.

FIG. 10*b* is a photomicrograph at 50X of an upset forging of a Ti-6242 alloy material using a conventional process with 70% α-β reduction followed by 30% reduction.

FIG. 10*c* is a photomicrograph at 50X of an upset forging of a Ti-6242 alloy material using a conventional process with 70% β-reduction followed by 30% reduction.

FIG. 11*a* is a photomicrograph at 50X of an upset forging of Ti-6242 alloy material using the process of this invention with 30% reduction, plus 4 minutes holding followed by 30% reduction, plus 4 minutes holding, followed by 30% reduction, plus 4 minutes holding, followed by 30% aspect forging; the view is of an edge portion.

FIG. 11*b* is a photomicrograph at 50X of an upset forging of Ti-6242 alloy material using the process of this invention with 30% reduction, plus 4 minutes holding followed by 30% reduction, plus 4 minutes holding, followed by 30% reduction, plus 4 minutes holding, followed by 30% aspect forging; the view is for a mid-radius portion.

FIG. 11*c* is a photomicrograph at 50X of an upset forging of Ti-6242 alloy material using the process of this invention with 30% reduction, plus 4 minutes holding followed by 30% reduction, plus 4 minutes holding, followed by 30% reduction, plus 4 minutes holding, followed by 30% aspect forging; the view is a center portion.

DETAILED DESCRIPTION OF THE PREFERRED EMBODIMENT

Figure 12A:
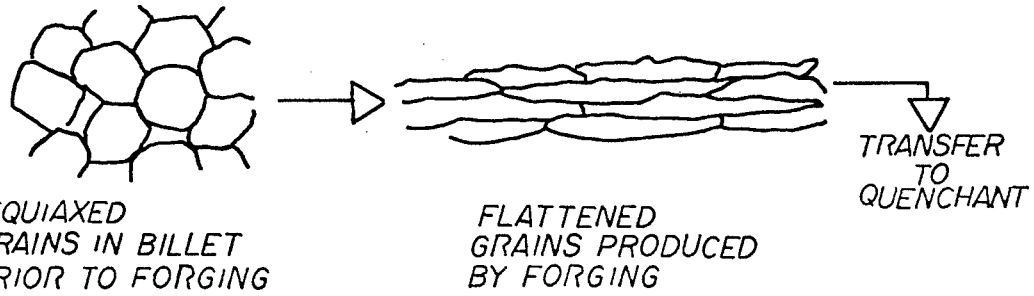
PRIOR ART FIG. 12A
FIG. 12*a* is a diagram showing the conventional forging process for titanium alloys wherein a billet has equiaxed grains prior to forging and flattened grains subsequent to forging.
Figure 12B:
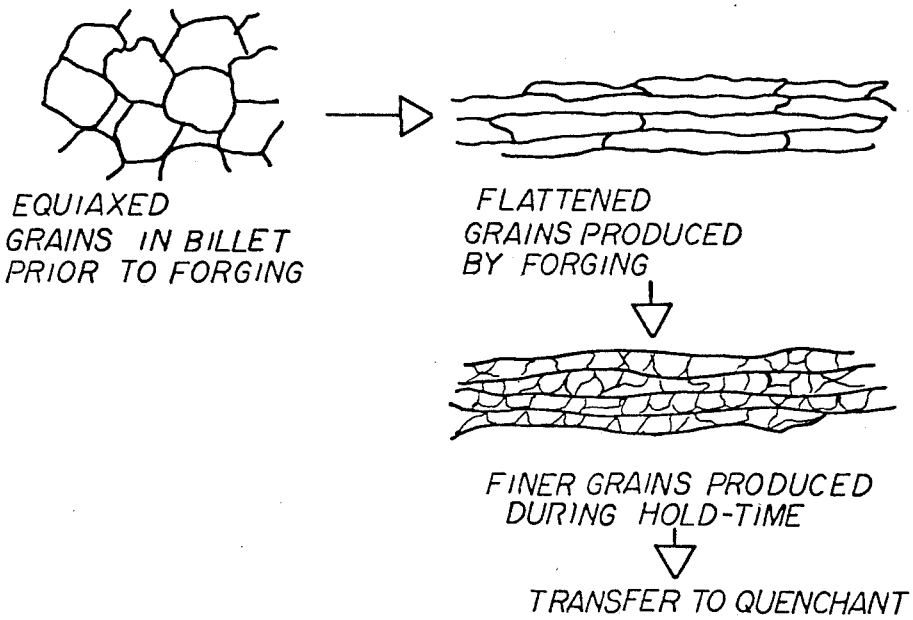
FIG. 12*b* is a diagram showing the process of the instant invention wherein a billet has equiaxed grains prior to forging, flattened grains subsequent to forging with finer, recrystallized β-grains produced during a holding period above the β-transus temperature.

The present invention provides a method for producing in a finish forging operation a fine grained titanium alloy having a maximum grain size no greater than of 0.5 mm by heating a titanium alloy billet generally to a temperature between 50° F. and 100° F. above that alloy's β-transus temperature, hot working the billet by pressing the billet in a heated isothermal press, holding the billet at a temperature generally within the range of 50° to 100° F. above the β-transus temperature to allow nucleation and grain growth, again pressing the billet in the heated isothermal press to deform the recrystallized grains and to change each grain's shape from equiaxed to flattened shape with each grain's long axis positioned in the radial direction and each grain's short axis positioned in the axial direction, and then quenching to arrest grain growth. The entire process preferably occurs at a temperature between 50° to 100° F. above the β-transus temperature; the temperature is not allowed to rise to the point of allowing dynamic recrystallization to proceed and is not allowed to fall below the β-transus temperature until the titanium alloy body is quenched.

This invention is further illustrated by the following examples. Standard Ti-17 and Ti-6242 billet material, typically seven (7) inches and eight (8) inches in diameter were utilized in a forging study. The experiments involved (a) evaluation of nucleation and grain growth kinetics in T-17 and in Ti-6242 billet material through short time static recrystallization studies ("short time" meaning a holding time less than 10 minutes), (b) correlation of the results of the recrystallization studies with metadynamic conditions (i.e., dynamic forging plus static holding at a specific temperature) through small scale upset forging, and (c) research and large scale upset forging under varied holding time conditions in order to demonstrate the feasibility of fine-grain titanium forging via the process of the instant invention, and to generate material for ultrasonic, non-destructive testing at high sensitivity. The theory of the instant invention was tested in preliminary experiments by forging test specimens above each specimen's β-transus temperature, cooling each specimen and then cutting small slices (e.g., one-tenth (1/10) of an inch in thickness) and heating those slices above that specimen's β-transus temperature and holding for varying lengths of time (e.g., 2, 4, 6 and 8 minutes), quenching the slices and observing the microstructure of each slice to determine the extent of recrystallization of β-grains. The results of those preliminary experiments are shown for Ti-17 forgings in FIGS. 1*a*–1*d* and are shown for Ti-6242 in FIGS. 2*a*–2*d*.

These preliminary experiments indicated that the grain nucleation and growth process occur in a short time (in less than ten (10) minutes) in titanium forgings as shown in FIGS. 1*a*–1*d* for Ti-17 forgings and in FIGS. 2*a*–2*d* for Ti-6242 forgings. As indicated, the nucleation and growth process was essentially complete in eight (8) minutes in the Ti-17 forging that was 70% β-reduced, that is, 70% β-forged. Even at lower reduction, e.g., 30% β-forged, the time remained the same. Moreover, the same results were obtained at 1650° F. and 1700° F. In the case of Ti-6242 as shown in FIGS. 2*a*–2*d*, the nucleation, grain growth and recrystallization process was faster than in the Ti-17 example and was completed in approximately four (4) minutes.

As illustrated in FIGS. 3 and 4, the data derived from these preliminary experiments indicates nucleation and very fast grain growth kinetics in both the Ti-17 and the Ti-6242 alloys and suggests that a finer grained titanium forging can be produced by employing a process utilizing a β-reduction followed by holding at the selected temperature to allow nucleation and grain growth, but only to the extent to replace the former hot-worked grains.

Next, the process of the instant invention was experimentally tested using small compression specimens of Ti-17 material. FIGS. 5*a*, 5*b*, 5*c*, 5*d*, 5*e*, 5*f*, 5*g*, and 5*h* show micrographic structures developed under a variety of forging conditions; the examples are for a strain rate of 0.1 per second. Similar results were obtained at 0.01 per second. In practice, under constant ram speed, the nominal strain rate typically will vary from 0.08 per second to 0.2 per second. The typical grain size in these specimens was 0.2 mm. It is important to note that a varied combination β-reductions (as well as a wide range of strain rates) can be tolerated in developing fine grains in the forging.

In addition, the process of the instant invention was experimentally tested using small compression specimens of Ti-6242 material. FIGS. 6*a*–6*c* show the test results with three hold times. It was found that a three (3) to four (4) minute hold time was adequate to develop fine grains in the range of 0.3 mm to 0.4 mm. These sizes show improvement over 0.6 mm to 0.9 mm grain sizes in conventionally forged Ti-6242 forgings.

Next, upset forgings were produced using a 2200 ton press from seven (7) inch and eight (8) inch diameter billets employing both a conventional forging process and the process of the instant invention. Utilization of both processes allowed for direct comparison of grain size in order to note any improvement. As shown in FIGS. 7a–7c for conventional forging processing of Ti-17, three types of forging conditions were used, namely, a. 30% ($\alpha+\beta$) blocking+70% $\beta$-finish
b. 70% ($\alpha+\beta$) blocking+30% $\beta$-finish
c. 70% $\beta$ blocking+30% $\beta$-finish The $\alpha+\beta$ blocking was at 1575° F. and all the other $\beta$-operations were done at 1675° F.

The grain structures are shown in FIGS. 7a–7c. Note that the grains with the 70% finish are very flat and disc shaped. All grains are of approximately the same size, and the few small grains seen are actually a cross section through a small chord of a flat grain. Thus, the grains are estimated to have a volume approximately 0.28 c. mm. The micrographs corresponding to 30% finish (FIGS. 7b–7c) show grains with only little aspect ratio, and assuming these to be spheres of average diameter 0.8 mm (i.e., a large grain with diametral section on the micrograph), the volume is estimated to be approximately 0.27 c. mm.

As shown in FIGS. 8a–8d, processing of Ti-17 according to the present invention ("hold-time processing") was undertaken using three types of forging conditions, namely, a. (30% $\beta$-forge+hold 8 minutes)+(30% $\beta$-forge+hold 8 minutes)+30% aspect forging.
b. (50% $\beta$-forge+hold 8 minutes)+(50% $\beta$-forge+hold 4.5 minutes)+30% aspect forging.
c. (70% $\beta$-forge+hold 8 minutes)+(30% $\beta$-forge+hold 4.5 minutes)+30% aspect forging.

Although some error was noted in the reduction in second step of forging under condition (a), namely, 10% instead of 30%, the process of the present invention successfully yielded finer grains of approximately 0.2 mm size. FIGS. 8a–8d and 9a–9d show examples of grain structure from forgings under conditions (b) and (c). A grain size range due to nucleation, grain growth and grain boundary impingement occurring during the hold time can be noted. The average diameter of the grain is estimated to be 0.15 mm, and the typical volume is 0.0018 c. mm. Thus, the hold-time processing is capable of placing approximately one hundred fifty (150) newly recrystallized grains in each "old" flat grain. It should be noted that the last step without hold time was given to develop an aspect ratio of approximately 3:1.

Similar forgings were made from Ti-6242. FIGS. 10a–10c show the grain structure under three (3) conditions conventional processing. These conditions were the same as those used for Ti-17 except that the ($\alpha+\beta$) blocking temperature was 1765° F., and the $\beta$-processing temperature was 1890° F. As shown in FIG. 10a, the 70% finish grains are flat discs, and an estimate of true volume of such a disc is 0.3 c mm. The 30% finish grains have low aspect ratio, and an estimate of the grain volume is 0.25 c. mm.

FIGS. 11a–11c show the grain structure following the hold-time processing of the instant invention. Unlike Ti-17, the hold time for Ti-6242 was four (4) minutes because of the faster grain growth kinetics in this alloy. The material showed a range of grain sizes with the largest grains still smaller than those developed under conventional forging techniques. In terms of volume, the typical grain under the hold-time process of this invention has a volume of approximately 0.033 c. mm. which translates to approximately eight (8) recrystallized grains in place of each a former flattened $\beta$-grain.

The process of the present invention requires a hold-time following an initial $\beta$-reduction, which hold-time varies with the alloy type. For Ti-17 and Ti-6242, these times have been determined to be eight (8) minutes and four (4) minutes, respectively. Also, this process requires isothermal conditions of forging in order to prevent diechill during hold-time. The forging ram speed, however, may be high as in conventional forging. The improvement in grain size as estimated from the volume ratio is about one hundred fifty (150) for Ti-17 and eight (8) for Ti-6242. In terms of typical grain size estimates from photomicrographs, grain size 0.2 mm or less in Ti-17 and 0.4 mm or less in Ti-6242 may be expected from this process. In addition, the sonicability of the Ti-17 forgings with the $\approx$0.2 mm grain size is improved by $\approx$40% over conventionally forged material.

What is claimed is:

1. A product having a maximum prior beta-grain size less than or equal to 0.5 mm and made from a titanium base alloy, by the process including the steps of selecting a billet of titanium base alloy, heating said billet to a first temperature within a range from 100% $\beta$-transus temperature to approximately 100° F. above said $\beta$-transus temperature, providing a forging press heated to a second temperature within said range which second temperature is not appreciably different from said first temperature, placing said billet within said forging press, then activating said forging press and pressing said billet while maintaining said billet's temperature at said second temperature, then holding said pressed billet at a third temperature within said range which is not appreciably different from said first and second temperatures for a time sufficient to allow mutual impingement of recrystallized fine grains one within another, but for a time insufficient to allow further grain growth, and then removing said billet from said forging press and quenching said billet to a fourth temperature, which fourth temperature is below the $\beta$-transus temperature, to arrest further grain growth and to establish said maximum prior beta-grain size.

2. The product of claim 1 wherein said range is between approximately 50° F. and approximately 100° F. above said $\beta$-transus temperature.

3. The product of claim 1 wherein said billet is further pressed in said forging press a second time, said second pressing occurring after said holding step, but before said removing and quenching steps.

4. The product of claim 2 wherein said billet is further pressed in said forging press a second time, said second pressing occurring after said holding step, but before said removing and quenching steps.

5. A method for refining; the $\beta$-grain size of an alloy selected from the group consisting of $\alpha$ and $\alpha$-$\beta$ type titanium base alloys, to produce a maximum prior $\beta$-grain size less than or equal to 0.5 mm, said method comprising the steps of:

selecting a billet of titanium base alloy, heating said billet to a first temperature within a range from the 100% $\beta$-transus temperature to approximately 100° F. above said $\beta$-transus temperature of said alloy, providing a forging press heated to a second temperature within said range and as close to said first temperature as possible, placing said heated billet within said forging press, then activating said forging press and pressing said billet while maintaining said billet's temperature within said range and as close to said first temperature as possible, then holding said pressed billet at a third temperature within said range and as close to said first temperature as possible for a time sufficient to allow mutual impingement of recrystallized fine grains one with another, but for a time insufficient to allow further grain growth, and then removing said billet from said forging press and quenching said billet to a fourth temperature, which fourth temperature is below the $\beta$-transus temperature, to arrest further grain growth and to establish said maximum prior $\beta$-grain size.

6. The method of claim 5 wherein said range is between approximately 50° F. and approximately 100° F. above said $\beta$-transus temperature.

7. The method defined in claim 5 further comprising pressing said billet in said forging press a second time, said second pressing occurring after said holding step, but before said removing and quenching steps.

8. The method defined in claim 6 further comprising pressing said billet in said forging press a second time, said second pressing occurring after said holding step, but before said removing and quenching steps.

9. A product made by the process of claim 8.

10. A product made by the process of claim 7.

11. A method for refining the $\beta$-grain size of an alloy selected from the group consisting of $\alpha$ and $\alpha$-$\beta$ type titanium base alloys, to produce a maximum prior $\beta$-grain size not to exceed 0.5 mm, said method comprising the steps of:

selecting a billet of titanium base alloy, heating said billet to a selected temperature within a range between about 50° F. and about 100° F. above the 100% $\beta$-transus temperature of said alloy, providing an isothermal press heated within said range, placing said billet within said press, pressing said billet with said isothermal press while maintaining a temperature as close as possible to said selected temperature within said range, holding said pressed billet as close as possible to said selected temperature within said range, allowing recrystallization of said $\beta$-grains to occur during said holding stem, said recrystallization occurring for a period of time sufficient to allow mutual impingement of fine recrystallized grains one with another, and then removing said pressed billet from said isothermal press and quenching said billet to a temperature blow the $\beta$-transus temperature to arrest further grain growth and to establish said maximum prior $\beta$-grain size.

12. A product made by the process of claim 11.

13. The method defined in claim 11 further comprising a second pressing step which second pressing step occurs immediately after said holding step and at a temperature as close as possible to said selected temperature.

14. The method defined in claim 13 further comprising a second holding step which second holding step occurs immediately after said second pressing step and at a temperature as close as possible to said selected temperature.

15. A product made by the process of claim 14.

* * * * *

UNITED STATES PATENT AND TRADEMARK OFFICE

CERTIFICATE OF CORRECTION

PATENT NO. : 5,026,520

DATED : June 25, 1991

INVENTOR(S) : Prabir R. Bhowal, ET AL

It is certified that error appears in the above-indentified patent and that said Letters Patent is hereby corrected as shown below:

Column 11, lines 26,28 and 30, delete the hyphen at the end of the line after the "+" because it looks like a "plus or minus".

Signed and Sealed this

Twenty-fourth Day of August, 1993

Bruce Lehman

*Attest:*

BRUCE LEHMAN

*Attesting Officer*

*Commissioner of Patents and Trademarks*